US005320158A

United States Patent [19]

Helgesen

[11] Patent Number: 5,320,158

[45] Date of Patent: Jun. 14, 1994

[54] METHOD FOR MANUFACTURING ENGINE BLOCK HAVING RECESSED CYLINDER BORE LINERS

[75] Inventor: Gary D. Helgesen, Romulus, Mich.

[73] Assignee: Ford Motor Company, Dearborn, Mich.

[21] Appl. No.: 5,467

[22] Filed: Jan. 15, 1993

[51] Int. Cl.[5] ..... B22D 19/00

[52] U.S. Cl. ..... 164/76.1; 164/98; 29/888.06; 29/888.061

[58] Field of Search ..... 164/97, 98, 100, 102, 164/76.1, 112, 111; 29/888.06, 888.061

[56] References Cited

U.S. PATENT DOCUMENTS

| | | | |
|---|---|---|---|
| 1,721,197 | 2/1925 | Almen | 29/447 |
| 1,730,905 | 10/1929 | Thomas et al. | 92/171.1 |
| 2,166,634 | 7/1989 | Lesage | 29/DIG. 6 |
| 2,387,971 | 10/1945 | Aspin et al. | 29/888.061 |
| 2,435,837 | 2/1948 | Larson | 29/523 |
| 3,069,209 | 12/1962 | Bauer | 164/111 |
| 3,073,290 | 1/1963 | Stump | 123/41.69 |
| 3,769,880 | 11/1973 | Mirjanic | 92/169.1 |
| 3,808,659 | 5/1974 | Alger, Jr. et al. | 419/8 |
| 4,109,617 | 8/1978 | Ernest | 123/41.74 |
| 4,197,899 | 4/1980 | Ernest | 164/34 |
| 4,394,850 | 7/1983 | Hayashi | 123/41.74 |
| 4,446,906 | 5/1984 | Ackerman et al. | 164/112 |
| 4,520,768 | 6/1985 | Shimonosono et al. | 123/41.44 |
| 4,554,893 | 11/1985 | Vecellio | 123/41.83 |
| 4,686,943 | 8/1987 | Anno et al. | 123/41.74 |
| 4,738,293 | 4/1988 | Tanino | 428/16 |
| 4,757,790 | 7/1988 | Ushio et al. | 428/614 |
| 4,759,317 | 7/1988 | Ampferer | 123/41.74 |
| 4,903,652 | 2/1990 | Field et al. | 123/193.2 |
| 5,050,547 | 9/1991 | Takahashi | 123/193.2 |
| 5,069,266 | 12/1991 | Nakatani et al. | 164/98 |

FOREIGN PATENT DOCUMENTS

| | | | |
|---|---|---|---|
| 58-112649 | 7/1983 | Japan | 164/100 |
| 59-85358 | 5/1984 | Japan | 164/98 |
| 560056 | 3/1944 | United Kingdom . | |
| 2168631 | 6/1986 | United Kingdom . | |
| 2168632 | 6/1986 | United Kingdom . | |
| 2193786 | 2/1988 | United Kingdom . | |
| 2194472 | 3/1988 | United Kingdom . | |
| 2194473 | 3/1988 | United Kingdom . | |

*Primary Examiner*—P. Austin Bradley
*Assistant Examiner*—Rex E. Pelto
*Attorney, Agent, or Firm*—Roger L. May; Joseph W. Malleck

[57] ABSTRACT

A method for manufacturing an engine block by sand mold casting techniques wherein the cylinder bore liners are recessed from the cylinder head contact surface of the engine block is provided. The outer surface of each cylinder bore liner has at least one circumferential groove formed therein. The cylinder liners are initially positioned in a barrel core box and a barrel slab core is formed by blowing resin coated sand into the core cavity of the barrel core box. Each liner is positioned in the barrel core box such that the groove remains free of sand during the core making process. The barrel slab core is then combined with other conventional core assemblies to form a cylinder block mold. The cylinder block mold is filled with a light alloy metal to produce an engine block casting with caste-in-place cylinder bore liners. The top end of the cylinder bore liners may be cast above or flush with the cylinder head contact surface of the engine block casting. The cylinder bore liners and the cylinder head contact surface are subsequently machined to produce an engine block wherein at least one cylinder bore liner is recessed from the cylinder head contact surface. The machining operations may include milling the top end of the cylinder bore liners and rough boring the inner surfaces of the cylinder bore liners.

16 Claims, 7 Drawing Sheets

METHOD FOR MANUFACTURING ENGINE BLOCK HAVING RECESSED CYLINDER BORE LINERS

BACKGROUND OF THE INVENTION

The present invention relates generally to engine block castings having cylinder liners and, more particularly, to a method for manufacturing by sand mold casting techniques an engine block having cylinder liners recessed below a cylinder head contact surface.

Fuel shortages and rising fuel costs have caused the automobile industry to expend considerable resources attempting to improve automobile fuel efficiency by reducing the weight and size of automobiles. A significant breakthrough in reducing the weight of the automobile was the advent of cast aluminum engine blocks. However, manufacturers soon discovered that aluminum could not endure the intense heat generated in a cylinder bore from fuel combustion and the wear resulting from piston friction.

In response to these problems, engine manufacturers developed the iron, cylinder bore liner. Various manufacturing methods have been utilized to produce an engine block with cylinder bore liners. For instance, many cylinder bore liners are inserted into the block casting by cold pressing. Alternatively, the engine block may be heated, causing the cylinder bore to expand, and the cylinder bore liner inserted therein. When the engine block cools, the cylinder bore contracts and holds the cylinder bore liner in position.

Automobile manufacturers also frequently caste-in-place the cylinder bore liners. The bore liner is cast-in-place in the cylinder bore of the engine block, thus reducing cylinder wall wear while still providing the weight advantages of an aluminum engine block. In prior cast-in-place liner processes, automobile manufactures employed semi-permanent mold casting techniques, low pressure casting techniques and high pressure die casting techniques to produce cast-in-place cylinder liners which are recessed from the cylinder head contact surface of the engine block. The cylinder head contact surface is contiguous to a cylinder head when the engine is assembled. Semi-permanent molds, for example, have a steel external shell and an internal sand core. Cylinder liners are initially positioned on steel mandrels extending from the external shell to the center of the cylinder bore. As a result of casting, the cylinder liners are cast-in-place in a position recessed from the cylinder head contact surface.

However, several problems are associated with semi-permanent mold casting techniques and high pressure die casting techniques. These techniques are very limited as to the number of details or features that can be included in the engine block casting. Consequently, a significant amount of machining must be performed on the engine block casting prior to assembling the engine. Significantly, sand mold casting techniques do not have these limitations or deficiencies.

In prior sand mold casting processes, however, the top end of the cylinder bore liner is cast flush with the cylinder head contact surface of the engine block casting. Finish machining of a cylinder head face in prior art processes presents significant problems, since the face is comprised of dissimilar metals, for example, iron and aluminum. A decreased cutter tool life and a rough machined surface finish are two problems associated with machining of dissimilar metals. These problems increase the cost of the engine, and can result in faulty head gasket sealing when such an engine is assembled.

Thus, it is apparent that a need exists for a method for manufacturing, by sand mold casting techniques, an engine block having cylinder bore liners recessed from the cylinder head surface, wherein the problems associated with machining dissimilar metals are eliminated.

SUMMARY OF THE INVENTION

This need is met by a method in accordance with the present invention for manufacturing an engine block wherein the cylinder bore liners are recessed from the cylinder head contact surface of the engine block. This eliminates the heretofore experienced problems associated with machining dissimilar metals during finishing of the cylinder head contact surface.

In accordance with one aspect of the present invention, a method for manufacturing an engine block having a cylinder head contact surface comprises the steps of: providing at least one cylinder bore liner having an inner surface, an outer surface, a head face end, a first portion adjacent the head face end, a second portion and a circumferential groove in the outer surface which separates the first portion and the second portion; performing casting operations to cast-in-place the at least one cylinder bore liner to form an engine block casting having a cast cylinder head contact surface; and performing machining operations on the engine block casting to produce an engine block wherein the at least one cylinder bore liner is recessed from the cylinder head contact surface.

The head face end of the cylinder bore liner may be cast flush with the head contact surface or above the head contact surface. Preferably, the step of performing machining operations includes the step of milling the engine block casting to remove substantially all of the first portion of the at least one cylinder bore liner. Further, the step of performing machining operations further includes the step of performing rough boring on the inner surface of the at least one cylinder bore liner to remove the circumferential groove of the at least one cylinder bore liner.

In the illustrated embodiment, the step of performing casting operations includes the steps of: positioning the at least one cylinder bore liner in a core box having a core cavity such that the circumferential groove is sealed from the core cavity; filling the core cavity with sand to form a barrel slab core including the at least one cylinder bore liner; curing the sand of the barrel slab core with a catalyst; removing the barrel slab core from the core box; using the barrel slab core to form a cylinder block mold having a block cavity; filling the block cavity with a liquified light alloy; and removing the sand of the barrel slab core, and other engine cores, to produce the engine block casting.

It is thus a feature of the present invention to provide an improved method for manufacturing an engine block having cylinder bore liners recessed from the cylinder head contact surface of the engine block such that additional finishing operations on the cylinder head contact surface can be performed on a unimetallic surface. Other features and advantages of the present invention will be apparent from the following description, the accompanying drawings and the appended claims.

DETAILED DESCRIPTION OF THE PREFERRED EMBODIMENT

Figure 1A:
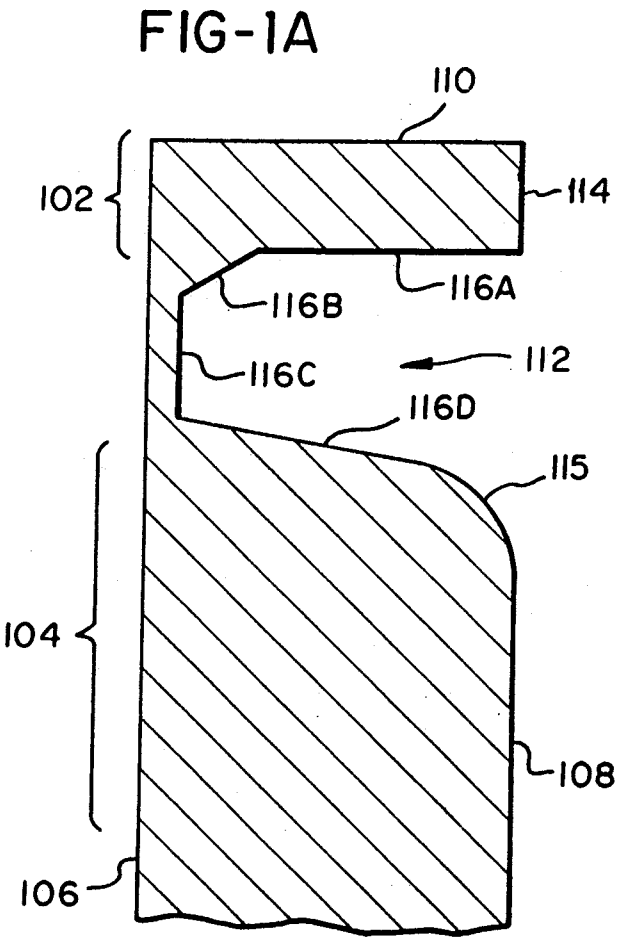
FIG. 1A is an enlarged partial sectional view taken along plane A—A, as shown in FIG. 1, illustrating one embodiment of the groove.
Figure 1:
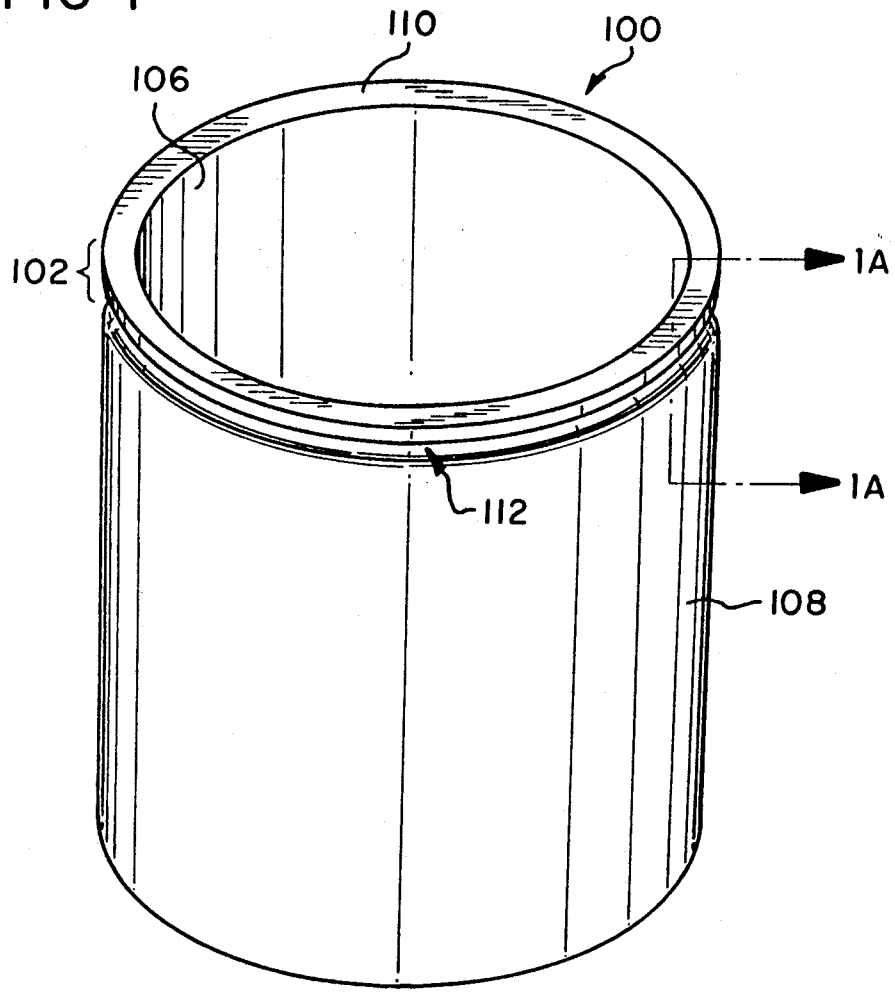
FIG. 1 is a perspective view of a cylinder bore liner having a groove to be cast-in-place in accordance with the present invention.
Figure 6:
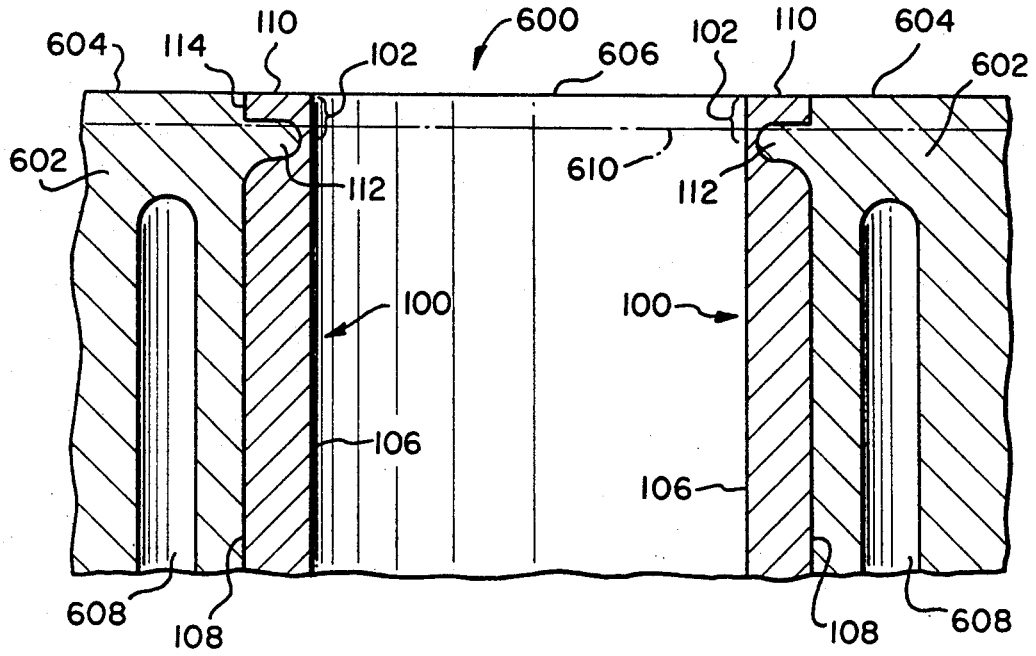
FIG. 6 is a partial sectional view of an engine block casting, produced from the cylinder block mold of FIG. 5, showing the cylinder bore liner of FIG. 1 cast therein in accordance with the present invention.
Figure 7:
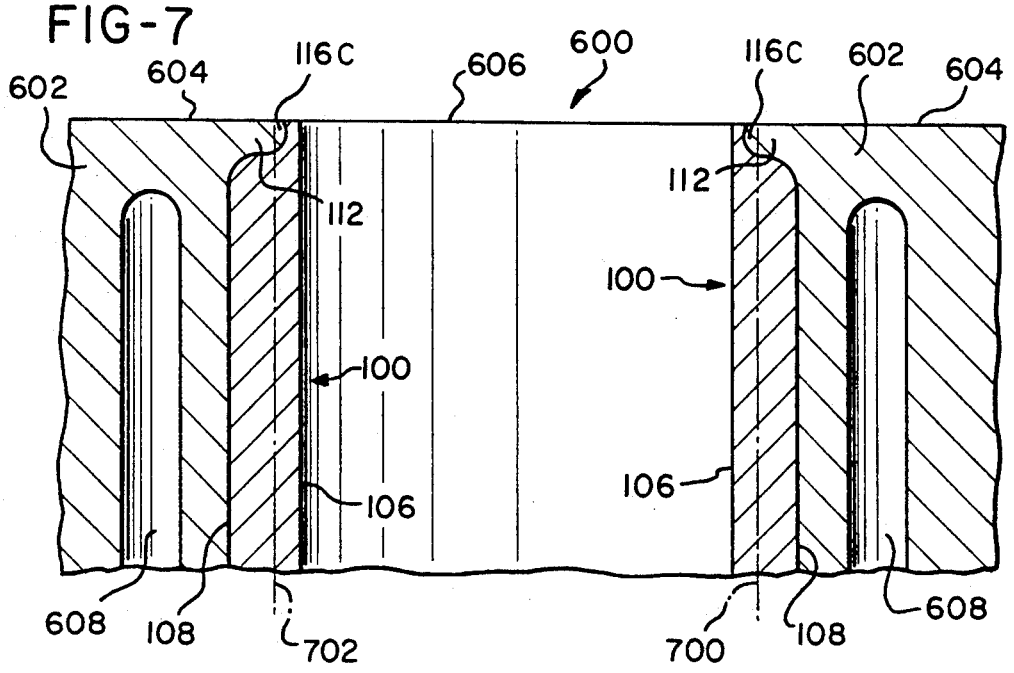
FIG. 7 is a partial sectional view of the engine block casting, as illustrated in FIG. 6, after a cubing operation has been performed on the cylinder head contact surface.
Figure 8:
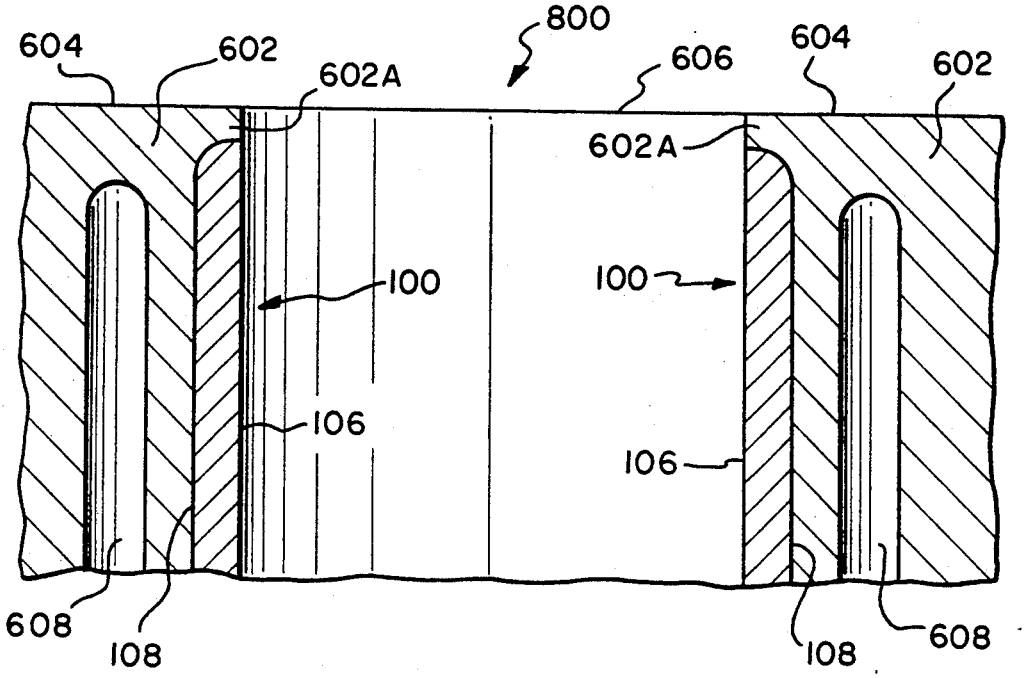
FIG. 8 is a partial sectional view of the engine block casting, as illustrated in FIG. 7, after a rough boring operation has been performed on the inner surface of the cylinder bore liner in accordance with the present invention.

Reference is now made to FIG. 1 of the drawings which illustrates a cylinder bore liner, generally designated 100, which is preferably comprised of iron. The cylinder bore liner 100 is comprised of a first portion 102, shown in more detail in FIG. 1A, a second portion 104 and a circumferential groove 112 separating said first and second portions 102 and 104. The cylinder bore liner 100 has an inner surface 106 which, after casting, ultimately defines the translational movement of an engine piston. Liner 100 has an outer surface 108 which, after casting, is contiguous to a engine block casting 600, as shown in FIGS. 6 to 8. A head face end 110 is shown located adjacent to the first portion 102. The length, inner diameter and outer diameter of the cylinder bore liner 100 are readily determined based on the design requirements of the particular engine in which the liner 100 is to be used.

A detailed illustration of one embodiment of the first portion 102 of the cylinder bore liner 100 of the present invention is shown in FIG. 1A. First portion 102 includes a flange 114 adjacent the head face end 110. The groove 112 formed, or preferably machined, in the outer surface 108 of the bore liner 100 has a curved section 115 adjacent to said second portion 104. The groove 112 is shown in the preferred embodiment having a first surface 116A substantially parallel to the head face end 110, a first sloped surface 116B contiguous to the first flat surface 116A, a second surface 116C contiguous to said first sloped surface 116B and substantially parallel to the inner surface 106 and a second sloped surface 116D which gradually inclines from said second surface to the curved section 115. The method of the present invention may be applied to any outer surface 108 configuration including smooth, fine thread, vertical rib, coarse spiral and cross hatch. Although the circumferential groove 112 is illustrated as having a configuration as shown in FIG. 1A, it should be apparent to one skilled in the art that the groove 112 may have other cross sectional shapes, such as rectangular, square or semicircular.

The specific dimensions associated with the groove 112, such as width, depth and distance from the head face end, are determined based on the subsequent machining to be done. However, the wall thickness of the bore liner 100 at the bottom of the groove 112, as indicated by reference number 116C, will typically be 0.015 to 0.02 inches, and the distance between the groove 112 and the head face end 110 will typically be in the range of 0.06 to 0.08 inches.

Figure 2:
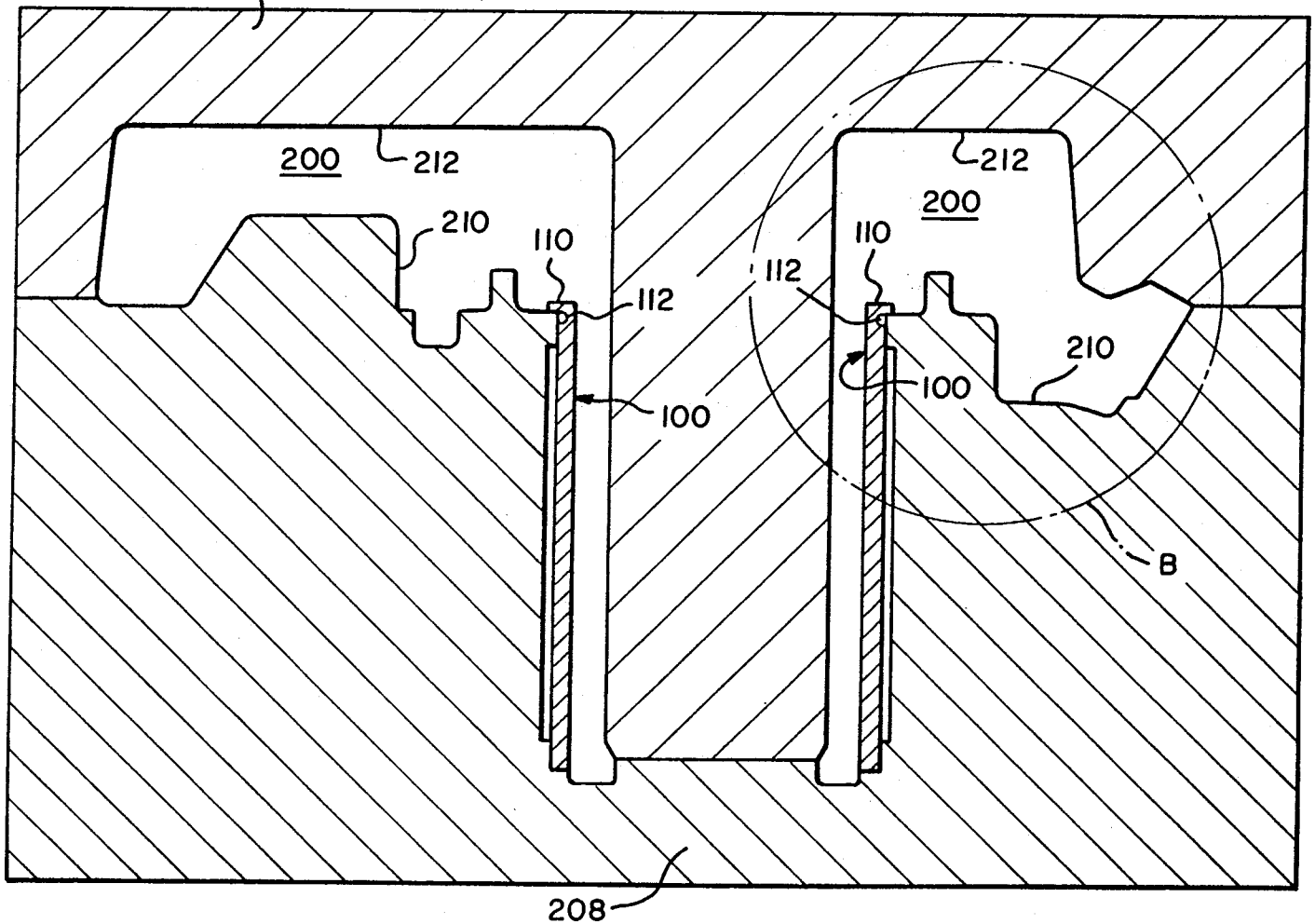
FIG. 2 is a cross sectional view of a barrel slab core box in which a cylinder bore liner, as shown in FIG. 1, is positioned in accordance with the present invention.
Figure 3:
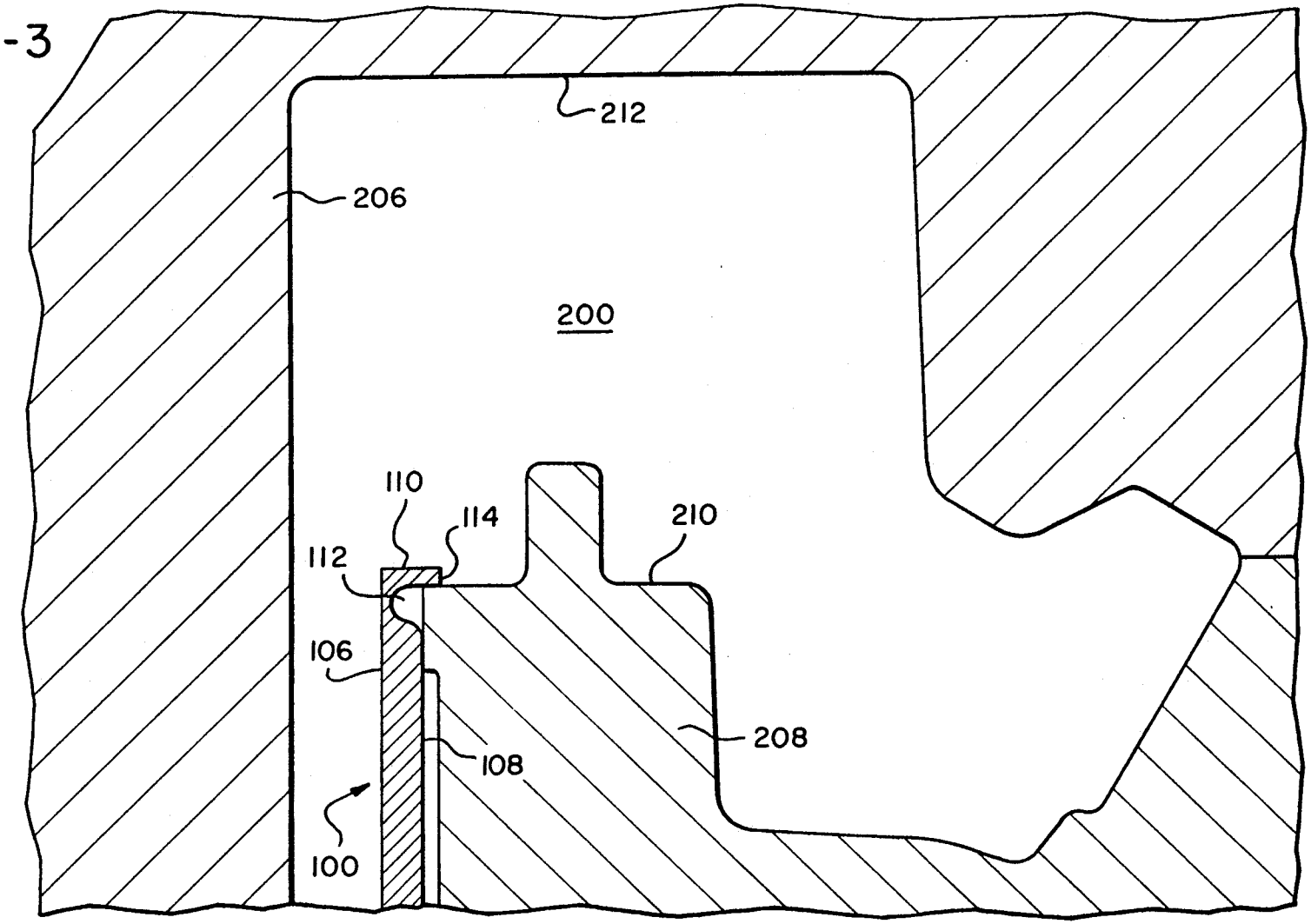
FIG. 3 is an enlarged view of section A of the barrel slab core of FIG. 2 showing the interrelationship between the cylinder bore liner and the barrel slab core box.

The method for manufacturing an engine block casting in accordance with the present invention will now be described with reference to FIGS. 2 through 8. The cylinder bore liner 100, shown in FIG. 2, is positioned in a core cavity 200 contained in a barrel slab core box 204. Box 204 is used to manufacture barrel slab cores, shown in detail in FIG. 4, from which engine block castings are produced. The core box 204 is comprised of a core box cover 206 superimposed on a core box base 208. A head deck surface 210, formed in the core box base 208, and an barrel core surface 212, formed in the core box cover 206, define the core cavity 200. The barrel core surface 212 forms the outer surface of the resulting barrel slab core.

Initially, the cylinder bore liner 100 is positioned in the core box base 208 and, thereafter, the core box cover 206 is secured to the core box base 208. An enlarged illustration of the interfacing between the cylinder bore liner 100 and the head deck surface 210 of the core box base 208, shown in section B of FIG. 2, is provided in FIG. 3. The flange 114 of the cylinder core liner 100 is contiguous to the head deck surface 210, thus sealing the circumferential groove 112 of the liner 100 from the core cavity 200.

Figure 4:
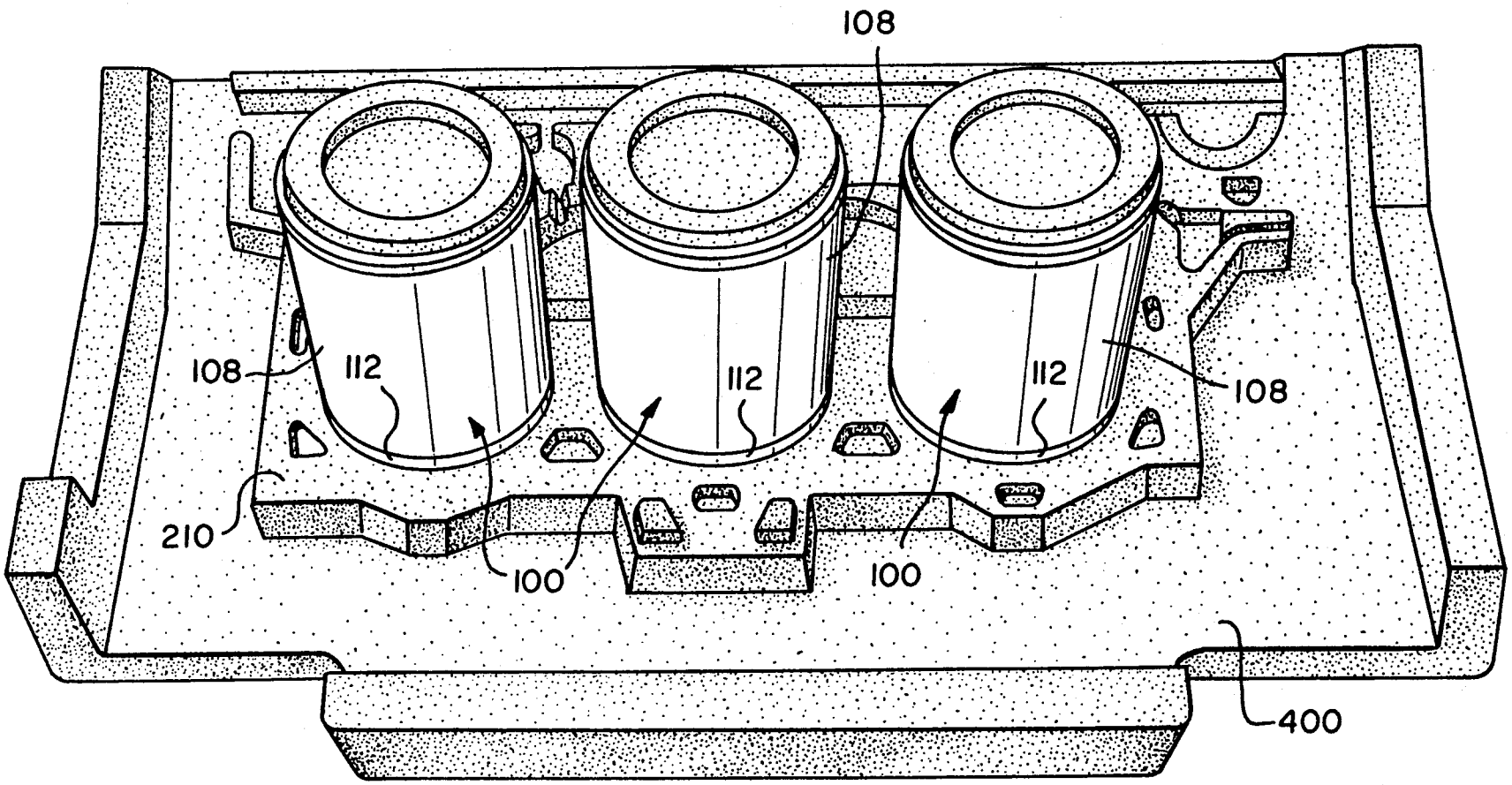
FIG. 4 is a perspective view of a barrel slab core with integral cylinder bore liners produced by filling the barrel slab core box, as illustrated in FIG. 2, with resin coated sand in accordance with the present invention.

After the liner 100 is positioned and the core box base 208 and cover 206 are secured to each other, resin coated sand is blown into the core cavity 200 and cured with a conventional catalyst. Since the circumferential groove 112 is insulated from the core cavity 200, the sand does not fill the groove 112. The resulting barrel slab core 400, including an integral cylinder bore liner 100, is shown in FIG. 4. The head deck surface 210 ultimately defines a cylinder head contact surface of the engine block after casting.

Figure 5:
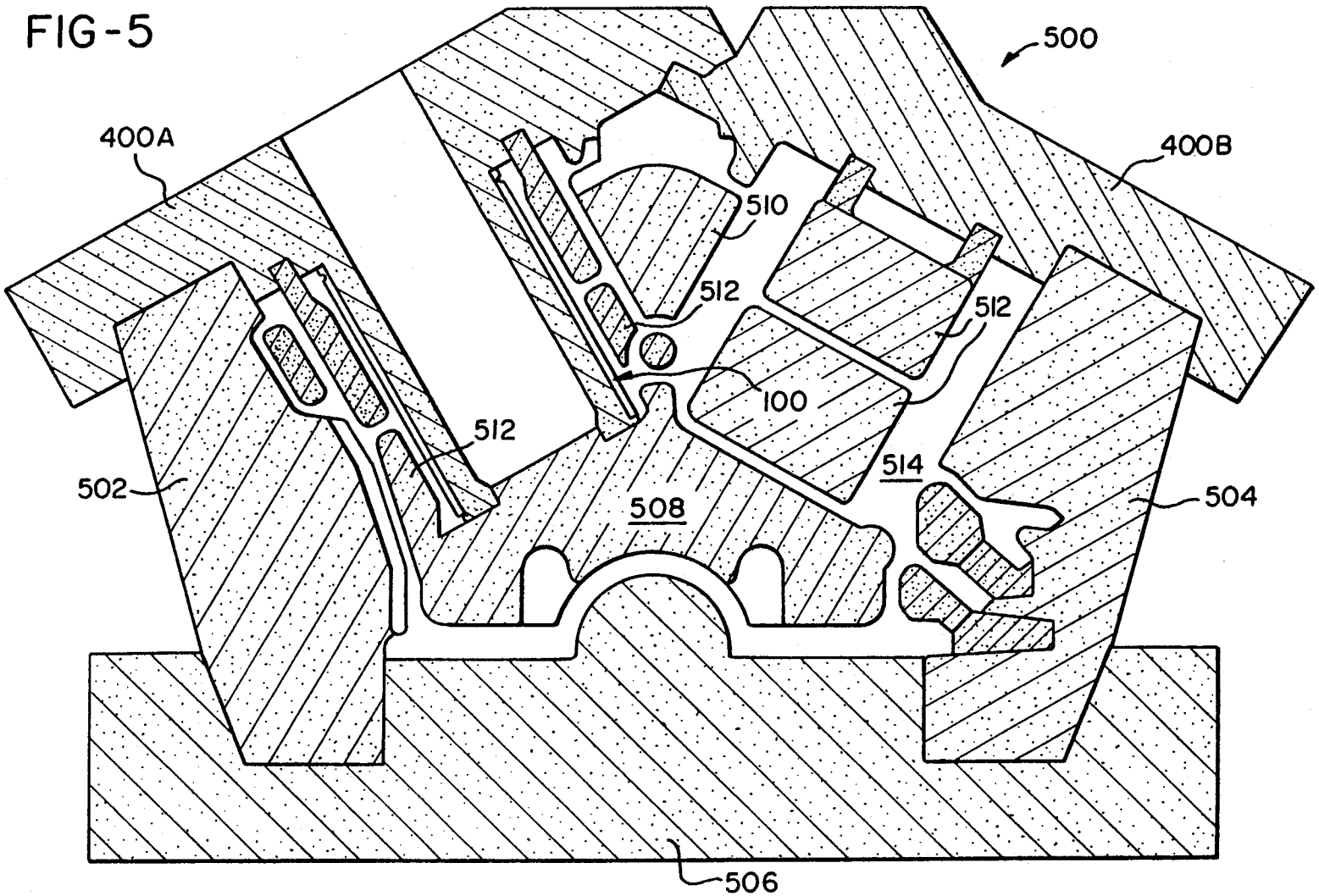
FIG. 5 is an offset cross sectional view of a complete cylinder block mold including a pair of barrel slab cores as shown in FIG. 4.

Reference is now made to FIG. 5 of the drawings, which shows an offset cross sectional view of a complete cylinder block mold 500, including a pair of barrel slab cores 400*a* and 400*b* and the cylinder bore liner 100 of the present invention. The barrel slab core 400*a* is shaded for clarification. The cylinder block mold 500 is further comprised of a pair of side core assemblies 502 and 504, a base core assembly 506, a crankcase core assembly 508, a breather core assembly 510 and a water jacket core assembly 512. Since the structure and manufacture of the various core assemblies are well-known in the art and are not important to the present invention beyond illustrating a complete cylinder block mold 500 wherein the present invention may be advantageously applied, further details of the various core assemblies will not be disclosed herein.

The mold cavity 514 within the cylinder block mold 500 is then filled with a light alloy metal, preferably aluminum. After the aluminum solidifies, the sand comprising the cylinder block mold 500 is removed by a conventional heating process, to yield a engine block casting, generally illustrated as reference numeral 600, with cast-in-place cylinder bore liners 100, as illustrated in FIG. 6.

Figure 9:
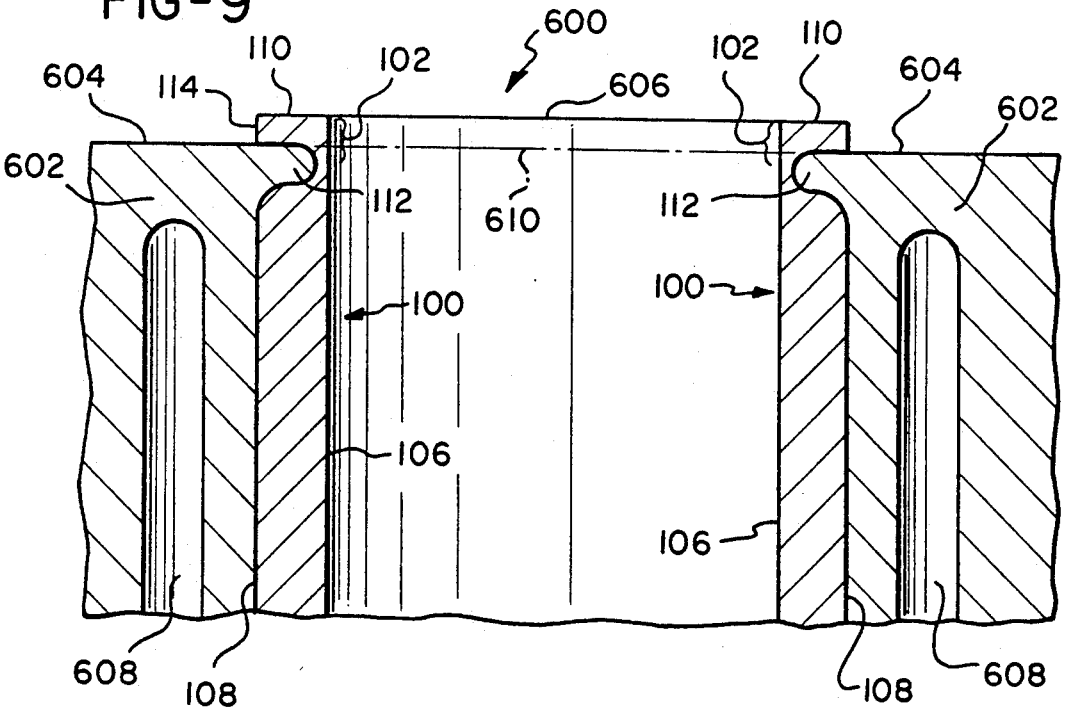
FIG. 9 is a partial cross sectional view of an engine casting in accordance with an alternative embodiment of the present invention wherein the head surface end of the cylinder bore liner is positioned above the cylinder head contact surface.

Referring now to FIG. 6, a cross sectional view of one cylinder of the engine block casting 600 is shown comprised of the cylinder bore liner 100 cast-in-place in an engine block body 602, preferably made of aluminum. The head face end 110 of the cylinder bore liner 100 is cast substantially flush with a cast body cylinder head contact surface 604 of the engine block body 602. Alternatively, as shown in FIG. 9, the head face end 110 of the cylinder bore liner may be cast above the cast body cylinder head contact surface. The cast body cylinder contact surface 604 and the head face end 110 of the cylinder bore liner 100 comprise the cylinder head contact surface, referenced generally at 606, of the engine block casting 600. A water jacket 608 surrounds the cylinder bore liner 100 to facilitate heat dissipation from the cylinder bore liner 100 and engine block body 602.

As part of the foundry cast finishing operations, a cubing operation, or more specifically rough milling, is then performed on the cylinder head contact surface 606. The amount of engine block body 602 and cylinder bore liner 100 removed during the cubing operation is indicated, for example, by dashed line 610.

As shown in FIG. 7, the cubing operation removes the flange 114 of the cylinder bore liner 100. The inner surface 106 of the cylinder bore liner 100 is then subjected to a rough cylinder boring operation to a depth indicated by lines 700 and 702, thus substantially removing the remaining metal of the first portion 102. As should be apparent, any boring depth sufficient to remove the bottom 116*c* of the circumferential groove 112 would be adequate.

The resulting light alloy engine block 800 with the cast-in-place cylinder bore liner 100 which is recessed below the cylinder head contact surface 606 is illustrated in FIG. 8. A portion 602*a* of the engine block body 602 is positioned between the cylinder bore liner 100 and the body cylinder head contact surface 606. Consequently, all subsequent finishing operations, such as final head milling, finish boring and finish honing, will be performed on a unimetallic surface. The heretofore experienced problems associated with machining dissimilar metals during finishing of the cylinder head contact surface 604 are therefore eliminated. As one skilled in the art will readily appreciate, the order in which the head contact surface is milled and the inner surface of the cylinder bore liner is bored depends on the specific cylinder liner configuration and may be interchanged.

Having thus described the method for manufacturing an engine block having cylinder liners recessed below a cylinder head contact surface of the present invention in detail and by reference to preferred embodiments thereof, it will be apparent that modifications and variations are possible without departing from the scope of the invention defined in the appended claims.

What is claimed is:

1. A method for manufacturing an engine block having a cylinder head contact surface, comprising the steps of:

providing at least one cylinder bore liner having an inner surface, an outer surface, a head face end, a first portion adjacent said head face end, a second portion and a circumferential groove in said outer surface which separates said first portion and said second portion;

performing casting operations to cast-in-place said at least one cylinder bore liner to form an engine block casting having a cast cylinder head contact surface; and performing machining operations on said engine block casting to produce an engine block wherein said at least one cylinder bore liner is recessed from said cylinder head contact surface.

2. The method as recited in claim 1 wherein said step of performing casting operations to cast-in-place said at least one cylinder bore liner includes the step of casting-in-place said at least one cylinder bore liner such that said head face end of said at least one cylinder bore liner is above said cast cylinder head contact surface.

3. The method as recited in claim 1 wherein said step of performing casting operations to cast-in-place said at least one cylinder bore liner includes the step of casting-in-place said at least one cylinder bore liner such that said head face end of said at least one cylinder bore liner is flush with said cast cylinder head contact surface.

4. The method as recited in claim 1 wherein said step of performing machining operations includes the step of milling said engine block casting to remove substantially all of said first portion of said at least one cylinder bore liner.

5. The method as recited in claim 1 wherein said step of performing machining operations further includes the step of performing rough boring on said inner surface of said at least one cylinder bore liner to substantially remove said circumferential groove of said at least one cylinder bore liner.

6. The method as recited in claim 1 wherein said step of providing said at least one cylinder bore liner includes the step of providing said circumferential groove having a cross sectional shape comprising a first surface substantially parallel to said head face end, a first sloped surface contiguous to said first surface, a second surface contiguous to said first sloped surface and substantially parallel to said inner surface and a second sloped surface which gradually inclines from said second surface to said second section of said cylinder bore liner.

7. The method as recited in claim 1 wherein said step of performing casting operations includes the steps of:

positioning said at least one cylinder bore liner in a core box having a core cavity such that said circumferential groove is sealed from said core cavity;

filling said core cavity with sand to form a barrel slab core including said at least one cylinder bore liner;

curing said sand of said barrel slab core with a catalyst;

ejecting said barrel slab core from said core box;

using said barrel slab core to form a cylinder block mold having a block cavity;

filling said block cavity with a liquified light alloy; and removing said sand of said barrel slab core to produce said engine block casting.

8. The method as recited in claim 7 wherein said step of removing said sand of said barrel slab core includes the step of heating said sand of said barrel slab core.

9. A method for manufacturing a light alloy engine block having a cylinder head contact surface comprising the steps of:

providing at least one cylinder bore liner having a head face end, an inner surface, an outer surface, a first portion adjacent to said head face end, a second portion and at least one circumferential groove which separates said first portion and said second portion;

performing sand mold casting operations to cast-in-place said at least one cylinder bore liner to form an engine block casting having a cast cylinder head contact surface;

milling said cast cylinder head contact surface and said head face end of said at least one cylinder bore liner to remove said shoulder segment of said at least one cylinder bore liner; and boring said inner surface of said at least one cylinder bore liner to remove said circumferential groove from said at least one cylinder bore liner such that said second portion of said cylinder bore liner is recessed from said cylinder head contact surface.

10. The method as recited in claim 9 wherein said step of performing sand mold casting operations to cast-in-place said at least one cylinder bore liner includes the step of casting-in-place said at least one cylinder bore liner such that said head face end of said at least one cylinder bore liner is flush with said cast cylinder head contact surface.

11. The method as recited in claim 9 wherein said step of performing sand mold casting operations to cast-in-place said at least one cylinder bore liner includes the step of casting-in-place said at least one cylinder bore liner such that said head face end of said at least one cylinder bore liner is positioned above said cast cylinder head contact surface.

12. The method as recited in claim 9 wherein said step of providing at least one cylinder bore liner includes the step of providing said circumferential groove having a cross sectional shape comprising a first surface substantially parallel to said head face end, a first sloped surface contiguous to said first surface, a second surface contiguous to said first sloped surface and substantially parallel to said inner surface and a second sloped surface which gradually inclines from said second surface to said second section of said cylinder bore liner.

13. The method as recited in claim 9 wherein said step of providing at least one cylinder bore liner includes the step of providing said circumferential groove having a semicircular cross sectional shape.

14. The method as recited in claim 9 wherein said step of performing sand mold casting operations includes the steps of:

positioning said at least one cylinder core liner in a core box having a core cavity such that said circumferential groove is sealed from said core cavity;

filling said core cavity with sand to form a barrel slab core including said at least one cylinder bore liner;

curing said sand of said barrel slab core with a catalyst;

ejecting said barrel slab core from said core box;

using said barrel slab core to form a cylinder block mold having a block cavity;

filling said block cavity with a liquified light alloy; and removing said sand of said barrel slab core to produce said engine block casting.

15. The method as recited in claim 14 wherein said step of filling said block cavity includes the step of filling said block cavity with molten aluminum.

16. The method as recited in claim 14 wherein said step of removing said sand of said barrel slab core includes the step of heating said sand of said barrel slab core.

* * * * *